United States Patent [19]

DuLoft

[11] 4,401,095

[45] Aug. 30, 1983

[54] FUEL-AIR MIXING DEVICE

[75] Inventor: Walter A. DuLoft, Ft. Walton Beach, Fla.

[73] Assignee: Taylor C. Miller, Jr., Montgomery, Ala.

[21] Appl. No.: 237,841

[22] Filed: Feb. 24, 1981

[51] Int. Cl.[3] ..... F02M 29/00

[52] U.S. Cl. ..... 123/590; 123/523; 48/180 C

[58] Field of Search ..... 123/523, 524, 590, 522, 123/591; 48/180 C; 261/DIG. 6, 96, 104

[56] References Cited

U.S. PATENT DOCUMENTS

| | | | |
|---|---|---|---|
| 1,980,496 | 11/1934 | Musselwhite | 123/523 |
| 2,033,753 | 3/1936 | Bucklen | 123/590 |
| 2,650,582 | 9/1953 | Green | 123/522 |
| 3,336,734 | 8/1967 | Schultz | 261/96 |
| 3,892,547 | 7/1975 | Tucker | 261/DIG. 6 |
| 4,153,651 | 5/1979 | Mears, Jr. | 261/DIG. 6 |
| 4,267,802 | 5/1981 | Garretson | 123/523 |

*Primary Examiner*—Charles J. Myhre
*Assistant Examiner*—E. Rollins Cross
*Attorney, Agent, or Firm*—Kenneth E. Darnell

[57] ABSTRACT

A device for forming a charge of fuel and air and for delivering the charge to an engine for combustion, the invention and the several embodiments thereof primarily comprise a chamber within which air and fuel are caused to mix. Fuel is introduced into the chamber and into contact with air which is caused to flow through the chamber. A portion of the fuel is vaporized within the chamber and is directed along with commingled air to the engine for combustion. That portion of the fuel which is not vaporized is returned to the fuel tank. Air is drawn into the chamber preferably by the influence of a vacuum created by the engine, the air preferably entering the chamber from more than one inlet and mixing with fuel introduced near the top of the chamber and onto a shroud over which at least a portion of the fuel spreads into a relatively thin layer as the fuel flows toward the lower portion of the chamber to mix with the air. Air is preferably drawn into the chamber internally of the shroud and at locations near the lower portion of the chamber and proximate to lower edge portions of the shroud.

17 Claims, 8 Drawing Figures

FUEL-AIR MIXING DEVICE

BACKGROUND AND SUMMARY OF THE INVENTION

Internal combustion engines conventionally require the mixing of an oxidizing material with fuel prior to entry of the fuel into a combustion chamber, the efficiency of this mixing being one of the most important factors in the overall efficiency of the engine. Typically, charge-forming devices are used in association with an internal combustion engine to mix fuel and oxidizer, usually air, to form a combustible charge which is then directed into the combustion chamber for burning. While certain engines operate somewhat differently, this same method of operation applies generally to all power plants which produce power by combustion of a fuel. In the most commonly used of these power plants, the charge-forming device is a "carburetor," a term loosely applied to literally thousands of widely differing yet generally similar devices which mix air/fuel to form a combustible charge prior to entry of the charge into the engine itself. Although many years of intensive effort have been directed toward production of efficient carburetion devices, it remains the case that this step of mixing fuel and air is a substantial cause of incomplete combustion within the engine. Incomplete combustion of fuel results in a lowered realization of the energy present in the fuel or, as is commonly said, results in "wasting gas."

Typically, carburetors have moving parts which must function in a cyclic manner to cause proper proportions of air and fuel to mix. Essentially all of the fuel introduced into the conventional carburetor is made a part of a given fuel/air charge and is drawn into the engine for combustion. Accordingly, the fuel introduced into the carburetor is thereby introduced into the engine even though the quantity of fuel may be excessive for efficient combustion. Due to the nature of prior charge-forming devices, as particularly embodied in the moving parts and in the functional interrelationship of these parts, inefficiencies in the utilization of fuel result. A continuing need thus exists in the art for apparatus capable of providing an efficient mixing of fuel and air to facilitate complete combustion in an engine.

The present invention is thus seen to provide apparatus for efficiently mixing fuel and air for delivery to an engine. The present apparatus functions to vaporize at least a portion of fuel introduced thereinto and to intimately mix this vaporized fuel with air prior to introduction of the resulting fuel/air mixture into the engine for combustion. The improved fuel/air mixing produced by the present apparatus allows more efficient combustion of the fuel by the engine, thereby resulting in greater utilization of the energy potential of the fuel and thus effecting economies by producing a greater amount of useful work for a given quantity of fuel. Operation of an engine used with the present apparatus is demonstrably more economical than the same engine operated with prior carburetion or other fuel supplying devices.

The present apparatus in its essence does not require moving parts and basically comprises a chamber within which air and fuel are caused to mix. The chamber is provided with an internal and inverted U-shaped shroud which separates the chamber into spatial volumes which communicate only along lower edges of the shroud. Fuel is introduced into the chamber above the shroud and impinges on outer surfaces thereof, at least a portion of the fuel flowing downwardly along the outer surfaces of the shroud in a relatively thin film. The fuel thus reaches the lower portion of the chamber and mixes with air entering the chamber from inlets disposed along lower side portions of a housing defining the chamber. The incipiently mixing air and fuel then move under the lower edges of the shroud into that volume lying within the interior confines of the shroud. An apertured air feed tube extends along the shroud internally of the volume confined by the shroud, the feed tube communicating with ambient at one end to draw air into the tube under the influence of a vacuum such as is created by the engine and as is connected to the other end of the feed tube. Turbulence within the chamber and within the feed tube is created by air moving within the feed tube, at least a portion of the air entering the chamber through the apertures in the feed tube to further mix with the air and fuel moving into the space under the shroud. Fuel and air thus become more intimately mixed under the shroud with the fuel becoming more completely vaporized. A continuous stream of mixed fuel and air is then drawn through the apertures into the feed tube and is directed into the engine, such as through the intake manifold, for combustion. Fuel not vaporized pools in a a return sump located at the bottom of the chamber, the unvaporized fuel being returned to the fuel tank or otherwise held for reintroduction into the chamber. Accordingly, fuel not sufficiently vaporized for efficient combustion is not charged into the engine but is "recycled".

Given the foregoing general description of the structure and operation of the present apparatus, it follows that a primary object of the several embodiments of the invention is to provide apparatus for efficiently mixing fuel and air for introduction into an engine or other fuel burning apparatus to effect more nearly complete combustion of the fuel than is possible with conventional charge-forming devices such as carburetors and the like.

It is another object of the invention to provide a fuel and air mixing apparatus which can be readily adapted to use with conventional and internal combustion engines such as are used to power vehicles without the need for substantial modification of such engines.

It is a further object of the invention to provide an improved fuel and air mixing apparatus capable of efficiently vaporizing fuel and mixing only vaporized fuel with air for delivery to a combustion chamber of an engine or other fuel burning apparatus in order to facilitate more nearly complete combustion of the fuel, unvaporized fuel being recycled into the apparatus for subsequent vaporization and mixing.

Further objects and advantages of the invention will become more readily apparent in light of the following detailed description of the preferred embodiments.

DESCRIPTION OF THE PREFERRED EMBODIMENTS

Figure 1:
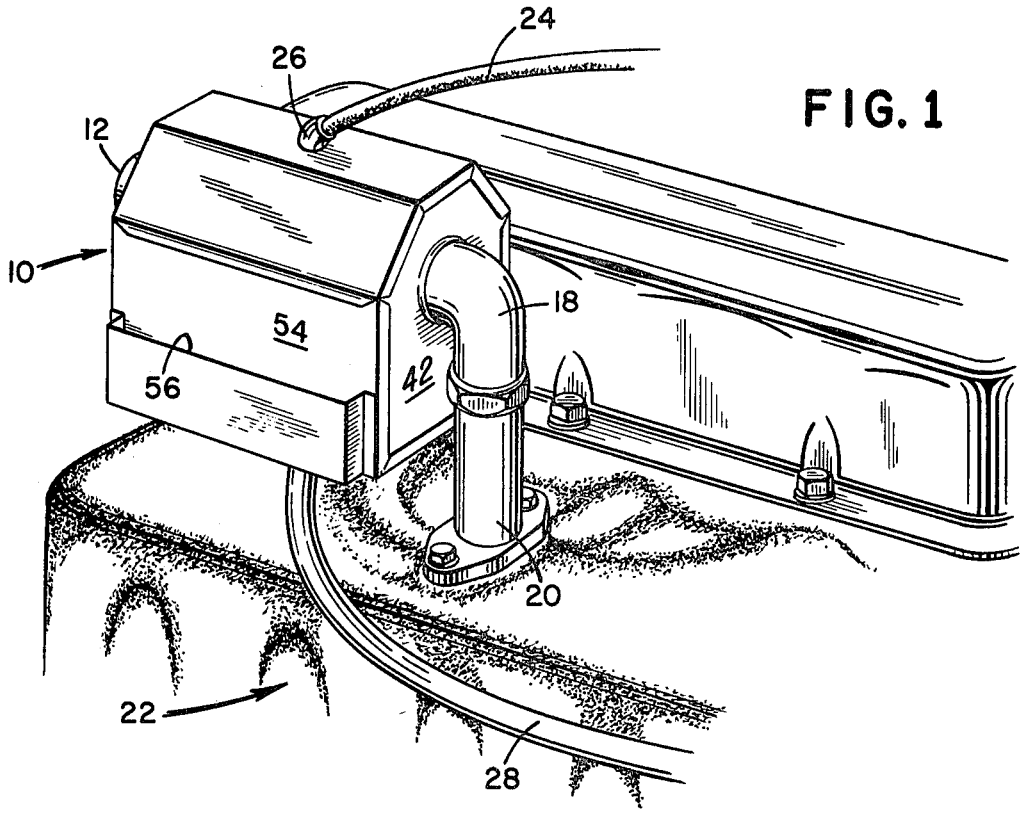
FIG. 1 is a perspective view of a first embodiment of the invention in a use environment.
Figure 2:
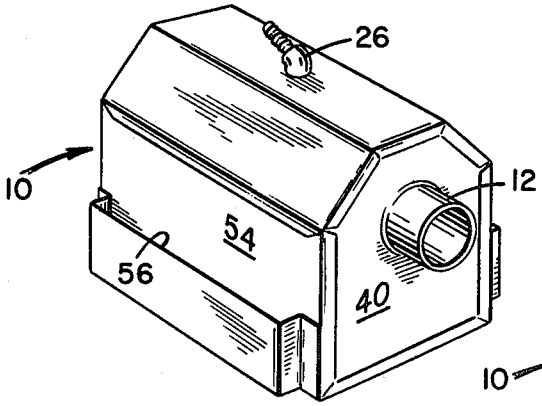
FIG. 2 is a perspective view of the embodiment of FIG. 1 with the structure turned in order to view portions of the apparatus not clearly visible in FIG. 1.

Referring to FIGS. 1–5, a first embodiment of the invention is seen to comprise a box-like housing shown generally at 10 and, as shown in FIG. 1, mounted on an internal combustion engine. The housing 10 communicates with ambient and receives air through inlet duct 12 which can communicate directly with the atmosphere as shown in FIGS. 1–5 which can be provided with air filtration and control devices of known construction as will be described hereinafter in a form of the invention described relative to FIG. 8. Air is drawn into chamber 14 defined by the housing 10 through the inlet duct 12, the duct 12 forming an externally extending portion of an apertured mixing tube 16 which extends through the chamber 14 at a height within the chamber which is preferably within the upper half of the chamber. The mixing tube extends through that wall of the housing 10 opposite the wall through which the inlet duct 12 extends, the respective walls being provided with apertures through which the tube 16 extends and within which the respective end portions of the tube are sealed. The portion of the tube 16 exiting the housing 10 at 18 preferably takes the form of an elbow and is not apertured. The elbow 18 is mechanically joined in a known fashion to an access pipe 20 which communicates with engine 22, preferably through the intake manifold of the engine 22. In practice, the access pipe 20 can be fitted to communicate with the engine 22 through the aperture in the conventional intake manifold which is commonly used to duct a fuel/air charge from a conventional carburetor into an engine such as engine 22. Fuel and air mixed within the chamber 14 according to the teachings of the present invention are ducted into the engine 22 through the access pipe 20. The structure thus shown in FIGS. 1–5 inter alia are capable of retrofit onto the vast majority of internal combustion engines now in use as well as onto other fuel-burning apparatus which operate at greatest efficiency with improved preliminary mixing of fuel with an oxidizing substance.

As can be generally seen in FIG. 1, a fuel supply line 24 extends in a conventional fashion from a fuel tank (not shown) to a fuel inlet 26 formed in an upper wall of the housing 10. A conventional fuel pump (not shown) can be employed to pump fuel through the fuel supply line 24 to the fuel inlet 26 for discharge into the chamber 14. As will be later described in more detail, a fuel return line 28 extends from a fuel outlet 30 disposed in a bottom wall of the housing 10, the line 28 extending back to the fuel tank (not shown) to return unused fuel thereto. The unused fuel is fuel which was not vaporized within the chamber 14 and thus not mixed with air for charging into the engine 22.

Figure 3:
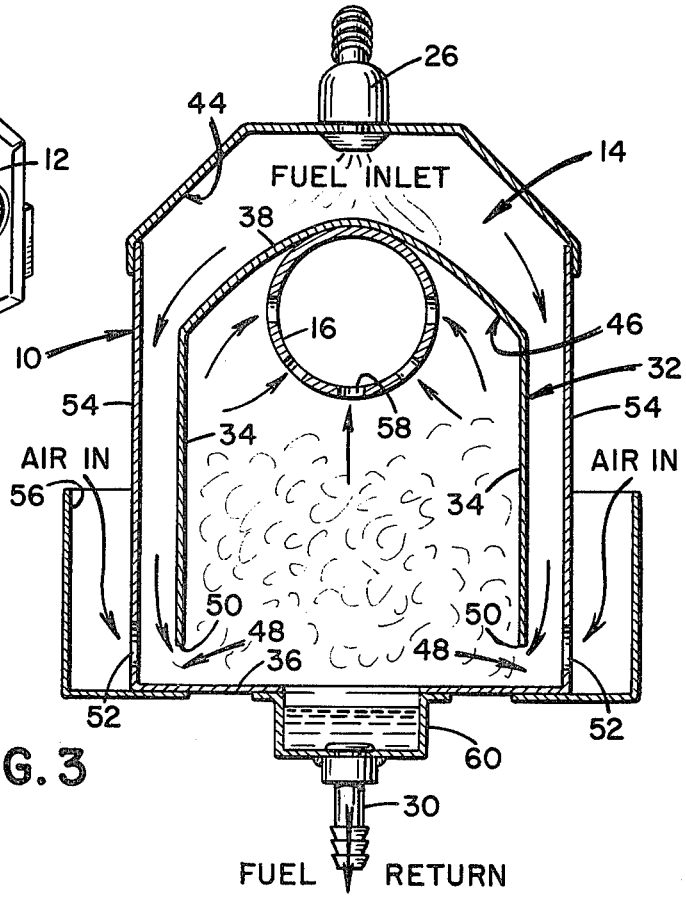
FIG. 3 is a front elevational view in section of a first embodiment of the invention.
Figure 4:
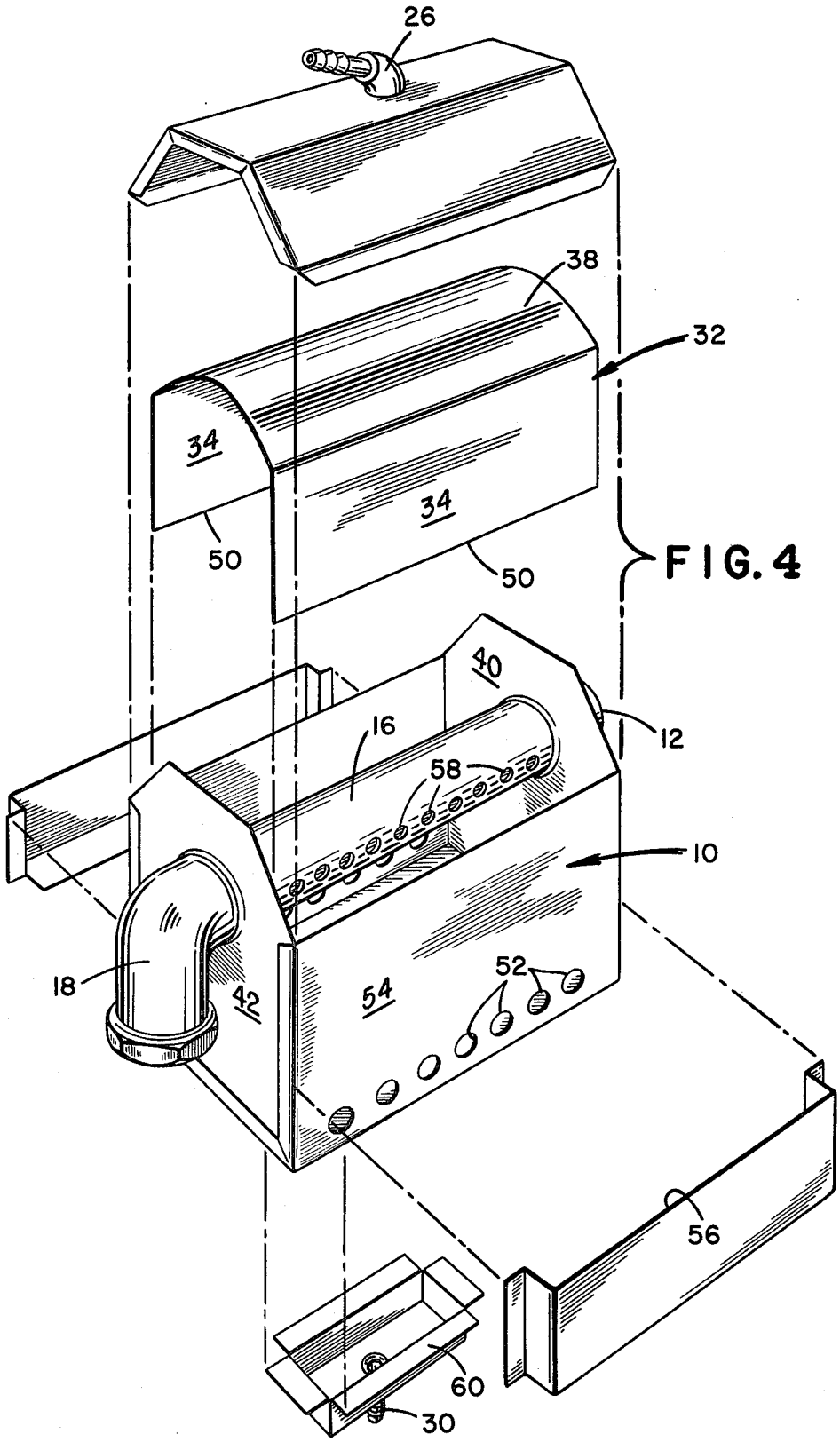
FIG. 4 is an idealized assembly view of the first embodiment of the invention.
Figure 5:
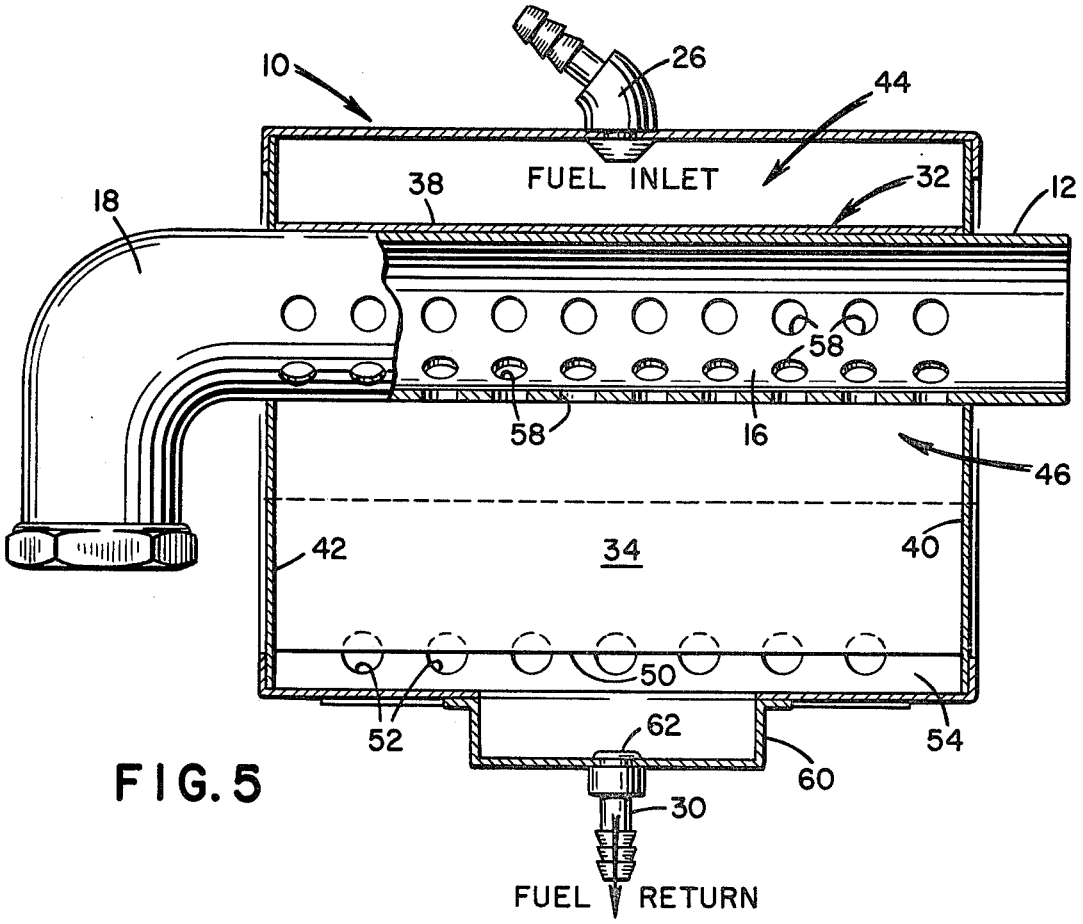
FIG. 5 is a side elevational view in partial section of said first embodiment.

Referring now primarily to FIGS. 3–5, the internal configuration of the first embodiment of the invention is best seen. A fume shroud 32 is seen to be disposed within the chamber 14 in a position surmounting and effectively encompassing the mixing tube 16. The shroud 32 takes the form of an inverted U-shaped element with leg members 34 extending downwardly within the chamber 14 to terminate along lines spaced from bottom wall 36 of the housing. Bight portion 38 of the shroud 32 fits over the mixing tube 16 and can, though not necessarily so, rest over said tube 16 in contact therewith. As best seen in FIG. 4, the leg members 34 of the fume shroud 32 take the form of flat plate members which are spaced apart and are mutually parallel. The bight portion 38 of the shroud 32 is an elongated arcuate member which joins the leg members 34 along the upper edges of said leg members. The fume shroud is mounted within the chamber 14 by direct connection to inner surfaces of forward and rear walls 40 and 42, the respective ends of the shroud 32 being flushly mounted to and effectively joined to the respective walls 40 and 42. Accordingly, communication between upper spatial volume 44 of the chamber 14 and lower spatial volume 46 can occur only through slot-like openings 48 which exist between lower edges 50 of the leg members 34 and the bottom wall 36.

In operation, fuel is charged into the chamber 14 through the fuel inlet 26, a liquid fuel being sprayed onto the upper surfaces of the fume shroud 32 and flowing downwardly along the outer surfaces of the shroud. The relatively thin sheet of fuel moving downwardly over the shroud 32 presents a large surface area for evaporation of the fuel. Further, fuel droplets present within the volume 44 also vaporize. The fuel vapors formed by the several evaporative mechanisms thus operating move downwardly along with liquid fuel which continues to at least partially vaporize.

Air enters the chamber 14 through side apertures 52 formed along lower portions of side walls 54, the apertures being preferably shielded by protective wells 56 comprised of trough-like side plates. The wells 56 can further be provided with permanent or "snap-on" filters (not shown) formed of materials such as wire mesh to prevent foreign matter from entering the apertures 52. The side apertures 52 are seen to be spaced from the lower edges 50 of the leg members 34 and to be disposed in medial alignment therewith. The edges 50 may also be disposed in height above the side apertures 52. Air entering the chamber 14 through the side apertures 52 mixes with the vaporizing fuel and acts to increase vaporization through turbulence and other mechanisms. This thus mixing air and fuel passes through the slot-like openings 48 and into the lower spatial volume 46 substantially defined by the inverted U-shaped fume shroud 32. Movement of the mixing gaseous fuel and air is caused in part by lower pressures existing within the volume 46 due to vacuum (such as from the engine 22) pull through apertures 58 in the mixing tube 16. This vacuum also pulls air into the mixing tube 16 through the inlet ducts 12 as aforesaid. Within the volume 46 encompassed by the fume shroud 32, at least portions of the unvaporized fuel are caused to evaporate and mix with air entering the chamber 14 through both the side apertures 52 and the mixing tube 16 (via the inlet duct 12). The thus mixing fuel vapor and air is drawn into the mixing tube 16 and discharges from the apparatus through that end of the mixing tube 16 opposite the inlet ducts 20, that is, through that end of the mixing tube 16 which extends outwardly of the chamber 14 and directly communicates with the engine 22 or other burning apparatus as aforesaid. At least a portion of the air entering the mixing tube 16 through the inlet duct 12 is seen to flow into the volume 46 and a mixture of air and fuel vapor is seen to pass into the mixing tube 16 for delivery to the engine 22. The flow of air through the apertures 58 and the tube 16 and into the volume 46 is seen to cause turbulence and to increase vaporization of the fuel and additional mixing of the vapor with air.

Fuel which remains unvaporized flows to sump 60 located preferably in a lowermost portion of the chamber 14. The sump 60 is provided with a fuel return valve 62 which connects to the fuel return line 28 previously described. The line 28 carries unvaporized, and thus unused, fuel back to the fuel tank (not shown) for reuse. A pump (not shown) can be used to return the unvaporized fuel to the fuel tank although the affects of inertia will cause fuel flow back through the line 28 to a rearwardly disposed fuel tank when the apparatus is used in a vehicle traveling in a forward direction.

Figure 6:
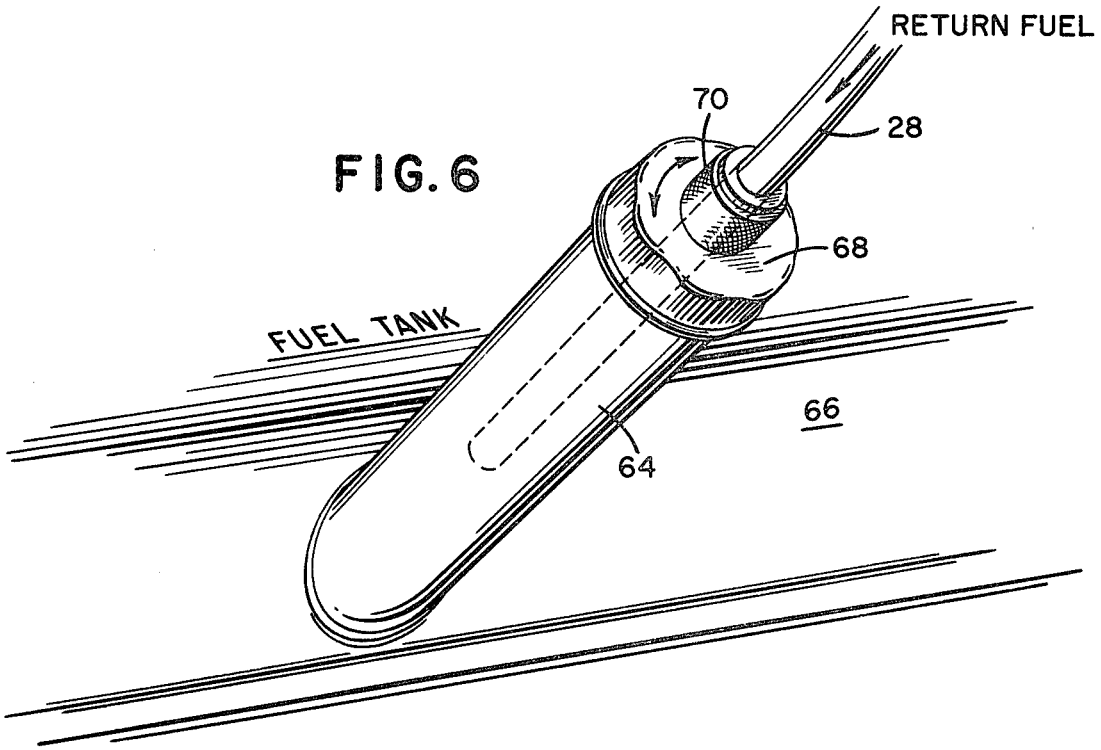
FIG. 6 is a perspective view of a modification of a fuel tank which can be used in concert with the present invention.

In a situation where the present apparatus is retrofit onto an existing engine previously operated with a conventional carburetor and for which no fuel return conduit to the fuel tank is necessary, it is possible to cause fuel return to the fuel tank through use of the mechanism shown in FIG. 6. The fuel return line 28 is fitted into inlet spout 64 of fuel tank 66 through a cap 68 having a rotatable fitting 70 which receives the end of the line 28 therethrough. Due to the fitting 70, the line 28 is not caused to rotate on rotation of the cap 68, such as occurs on removal of said cap to allow filling of the tank 66 with fuel. Alternatively, the fuel return line 28 can be caused to enter a fuel tank by a direct, permanent connection such as the conventional connection between a fuel supply line and a fuel tank.

The housing 10 of the mixing apparatus shown in FIGS. 1–5 inter alia can be formed of materials as simple as conventional sheet metal binded together by brazing, welding, adhesives, etc. The apparatus is seen to have no moving parts per se, to be lightweight, and to be easily fabricated from relatively inexpensive materials. The housing 10 can be configured other than as shown in FIGS. 1–5, the box-like construction shown being merely one simple structural mode which is readily fabricated and adequate to the purposes intended. The apparatus is sufficiently lightweight to allow mounting only by the connection of the elbow 18 to the access pipe 25 shown in FIG. 1. The apparatus can, of course, be otherwise mounted to the engine 22.

Figures 7, 8:
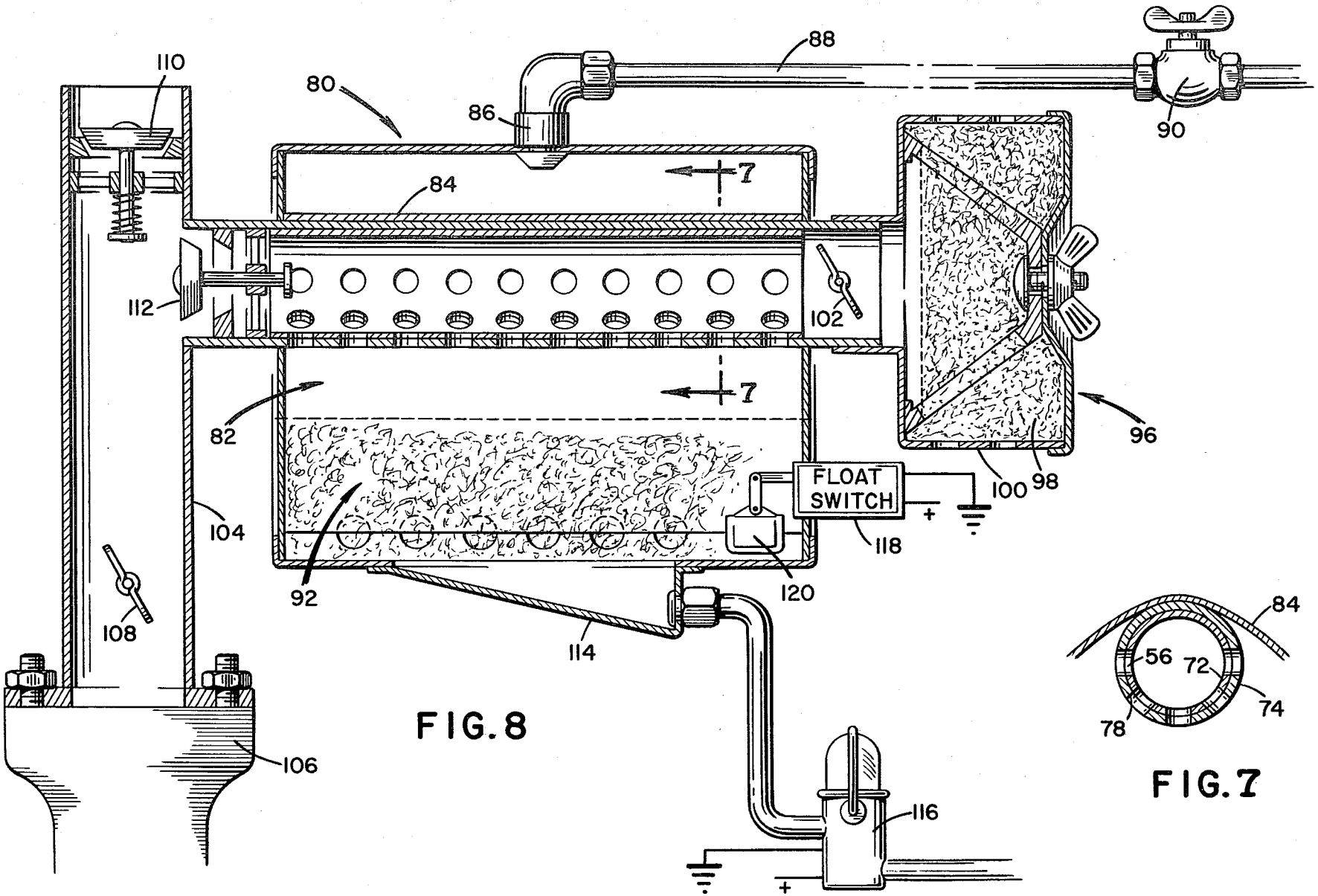
FIG. 7 is a detailed sectional view of a concentric mixing and control tube arrangement comprising a further embodiment of the invention.
FIG. 8 is a side elevational view in partial section with portions of the structure shown schematically and illustrating a further embodiment of the invention.

Referring now to FIG. 7, a modification of the mixing tube 16 of FIGS. 1–5 is seen to comprise an apertured mixing tube 72 which is substantially identical in construction and location within the present apparatus to the mixing tube 16. However, the mixing tube 72 is concentrically mounted within an apertured mixture control tube 74. Both of the tubes 72 and 74 have apertures 76 and 78 which are essentially identical in size and which can be aligned, such as on rotation or sliding of the control tube 74. The total area of the openings thus exposed through the mixing tube 72 can be controlled by the degree of alignment between the apertures 76 and 78 of the tubes 72 and 74. This alignment can be manually set or can be controlled automatically, such as in response to the vacuum sensed from an engine, in response to computer control, or in response to thermal sensors such as in the exhaust of an engine being operated with the present apparatus. The concentric tube structure can thus be used to provide improved mixing by "leaning" a mixture of fuel and air to a peak temperature, such as can be sensed by an exhaust gas temperature probe, and then subsequently enriching the mixture to provide an optimum mixture for operational advantages including lowered emissions.

A second embodiment of the invention is shown in FIG. 8, basic portions of the apparatus of FIG. 8 being essentially identical to the apparatus of FIG. 1. In FIG. 8, the concentric tube arrangement of FIG. 7 is incorporated into the apparatus. Housing 80 defines a chamber 82 within which fume shroud 84 is disposed in a manner which can be identical to the arrangement of the housing 10, chamber 14, and fume shroud 32 of FIGS. 1–5. Fuel inlet 86 and fuel supply line 88 also correspond to the elements 26 and 28 of FIGS. 1–5. However, the fuel supply line 88 is seen to have a control valve 90 disposed therein, the valve 90 being shown as a manual valve even though control can be effected in a variety of ways. The valve 90 can be disposed within reach of a user for controlling the quantity of fuel allowed to flow into the housing 80. In this manner, the richness of the fuel/air mixture exiting the housing 80 can be varied in a fashion similar to variations of the exposed total aperture area accomplished by the concentric tube arrangement of FIG. 7. The valve 90 can effectively be used as a manual choke to enrich the fuel/air mixture exiting the housing 80, it being necessary to adjust the richness of the mixture under certain operating conditions such as "in-town" or "hill" driving when the apparatus is used with the power plant of a vehicle. The valve 90 can also be controlled by provision of an exhaust temperature sensing and servomechanical system which senses the operating condition of the engine and adjusts fuel flow accordingly. A combination of such systems, which can include a sensing of vacuum conditions in an engine, with a computer to effect control of fuel to the present apparatus is within the state of the art given the present teachings.

The chamber 82 in the embodiment of FIG. 8 can also be provided with a quantity of a material 92 such as "brass wool" or the like which presents evaporation surfaces for promotion of fuel vaporization and thus sufficient mixingg of fuel with air. Vaporization can also be increased by preheating of the fuel, heating of the chamber, or preheating the air. Waste heat from the engine itself can be utilized for such purposes.

Inlet duct 94 comprising the free end of the control tube 74 (or which can comprise the free end of the mixing tube 72) is seen in FIG. 8 to be fitted with a filter element 96 which is essentially of conventional design, the element 96 having a conventional filter pad 98 held by an apertured filter housing 100. A butterfly valve 102 preferably located in the throat of the duct 94 can be controlled in response to vacuum induced within the chamber 82 to vary air flow into the chamber. The valve 102 can be otherwise controlled by sensors such as are mentioned relative to flow control herein. The valve 102 can also be controlled by connection to the usual accelerator of an engine operating in a vehicle. In such a situation employing a stationary valve for the valve 102, the valve would be self-adjusting during idling.

The mixing tube 72 of the embodiment of FIG. 8 is seen to communicate externally of the housing 80 downstream of the air flow with a stand pipe 104 which communicates with intake manifold 106 of an engine. A fuel intake butterfly valve 108 can be disposed either within the throat of the intake manifold 106 or within the lower portion of the pipe 104 as shown for control of entry of the fuel/air mixture into the engine. The pipe 104 is provided with a spring-loaded backfire valve 110. A valve 112 disposed in the external portion of the concentric tubes 72 and 74 and at the point of communication between said tubes and the pipe 104 is adapted to close when vacuum is not exerted thereon to keep said valve open. The stand pipe 104 with the associated valves 110 and 112 provides a safety arrangement which prevents damage to the present apparatus and which reduces operational hazards such as fire and the like.

The housing 80 is also seen to be fitted with a sump 114 which collects liquid fuel for return to the fuel tank (not shown) by means of an electric fuel pump 116. Pump 116 can be operated by means of a float switch 118 controlled by float 120. Fuel is thus not caused to be ducted back to the fuel tank until the level of liquid fuel in the chamber 82 reaches a predetermined level.

The several embodiments of the invention exhibit common modes of operation regardless of structural differences. In particular, it is seen that a countercurrent mixing of fuel and air occurs in the chambers 14 and 82 of the two expressly defined embodiments of the invention. In these embodiments, air is ducted into the chambers 14 and 82 through two separate sources essentially flowing in counterrelation to each other to provide turbulence and to increase vaporization of fuel, thereby promoting mixing of air and fuel. The basic structural configurations of the herein-described invention comprise structure having no parts which must move in a functional relationship with other parts in any manner which would be considered cyclic and capable of becoming unsynchronous due to wear or maladjustment. The present invention is thus seen to provide simplified apparatus capable of replacing conventional carburetor devices on internal combustion engines or fuel mixing devices used with other apparatus for burning fuel and oxidizer mixtures.

While the invention has been particularly described relative to at least two explicitly shown embodiments of the invention, it is to be understood that the invention can be otherwise embodied without departing from the scope of the invention as defined by the appended claims.

What is claimed is:

1. Apparatus for mixing a vaporizable fuel and a gaseous oxidizer, comprising:

a housing defining a mixing chamber;

fuel inlet means formed in the housing for feeding fuel into the chamber;

a shroud mounted within the mixing chamber, the shroud comprising an inverted, U-shaped structural element having opposed leg portions and an arcuate bight portion connecting upper edge portions of the leg portions, lower edge portions of the leg portions extending downwardly into spaced relation with lower floor portions of the chamber, the shroud extending throughout the chamber to separate the chamber into a first volumetric portion lying above and along outer surfaces of the shroud and a second volumetric portion lying within the confines of the shroud and bounded by inner surfaces of the shroud, the first and second volumetric portions communicating through openings formed between said lower edge portions of the leg portions and the lower floor portions of the chamber, the fuel inlet means directing liquid fuel onto upper and outer portions of the shroud to facilitate vaporization thereof, the vaporized fuel mixing with air present in the first volumetric portion of the chamber and moving downwardly within the chamber and through the openings and into the second volumetric portion;

air feed means carried by the housing for feeding gaseous oxidizer into the chamber and into mixing relation with the fuel vaporizing within the chamber, the fuel being further vaporized by mixing with the gaseous oxidizer thus delivered into the chamber; and means communicating with the interior of the chamber and carried by the housing for ducting mixed fuel vapors and gaseous oxidizer from the chamber.

2. The apparatus of claim 1 and further comprising sump means carried by the housing for pooling unvaporized fuel and for returning the unvaporized fuel to a source of supply.

3. The apparatus of claim 1 and further comprising means communicating with and connected to the ducting means for creating at least a partial vacuum within at least the ducting means for drawing mixed fuel vapors and gaseous oxidizer from the chamber.

4. The apparatus of claim 1 and further comprising means operatively connected to the fuel inlet means for varying the flow of fuel into the mixing chamber.

5. The apparatus of claim 1 and further comprising means disposed within the interior of the chamber for providing evaporation surfaces which facilitate evaporation of the fuel.

6. The apparatus of claim 1 wherein the ducting means comprise a fuel return conduit extending from the housing to a fuel tank having an inlet port fitted with a removable cap, the distal end of the conduit extending through an aperture formed in the cap, and means carried by the cap for securing the distal end of the conduit thereto and allowing rotation of the cap relative to the body of the conduit.

7. The apparatus of claim 1 wherein the air feed means comprise:

a mixing tube extending through the housing and disposed within the confines of the shroud, that portion of the tube disposed internally of the housing having apertures formed therein to communicate the interior of the tube with the chamber, one end portion of the tube extending externally of the housing and being in free communication with a source of gaseous oxidizer, and the opposite end portion of the tube extending through an opposite portion of the housing communicating with said ducting means; and apertures formed in the housing through which ambient gaseous oxidizer passes into the chamber for mixing with fuel vaporized therein.

8. Apparatus for mixing a vaporizable fuel and a gaseous oxidizer, comprising:

a housing defining a mixing chamber;

fuel inlet means formed in the housing for feeding fuel into the chamber;

a shroud mounted within the mixing chamber, the fuel inlet means directing fuel onto upper and outer surfaces of the shroud to facilitate vaporization of the fuel;

air feed means carried by the housing for feeding gaseous oxidizer into the chamber and into mixing relation with the fuel vaporizing within the chamber, the air feed means comprising a mixing tube extending through the housing and disposed within the confines of the shroud, that portion of the tube disposed internally of the housing having apertures formed therein to communicate the interior of the tube with the chamber, one end portion of the tube extending externally of the housing and being in free communication with a source of gaseous oxidizer, and the opposite end portion of the tube extending through an opposite portion of the housing, the air feed means further comprising a control tube concentric with and movable relative to the mixing tube and having apertures formed therein which are alignable with the apertures formed in the mixing tube to vary the degree of communication between the interior of the mixing tube and chamber, and means connected to the control tube for displacing said control tube to control the alignment between the respective apertures formed in the tubes, thereby to vary the degree of communication between the interior of the mixing tube and the chamber; and means communicating with the interior of the chamber and carried by the housing for ducting mixed fuel vapors and gaseous oxidizer from the chamber, the said opposite end portion of the mixing tube communicating with said ducting means.

9. The apparatus of claim 8 and further comprising sump means carried by the housing for pooling unvaporized fuel and for returning the unvaporized fuel to a source of supply.

10. The apparatus of claim 8 wherein the air feed means further comprise apertures formed in the housing through which ambient gaseous oxidizer passes into the chamber for mixing with fuel vaporized therein.

11. The apparatus of claim 8 and further comprising means communicating with and connected to the ducting means for creating at least a partial vacuum within at least the ducting means for drawing mixed fuel vapors and gaseous oxidizer from the chamber.

12. The apparatus of claim 8 wherein the shroud comprises an inverted, U-shaped structural element having opposed leg portions and an arcuate bight portion connecting upper edge portions of the leg portions, lower edge portions of the leg portions extending downwardly into spaced relation with lower floor portions of the chamber, the shroud extending throughout the chamber to separate the chamber into a first volumetric portion lying above and along outer surfaces of the shroud and a second volumetric portion lying within the confines of the shroud and bounded by inner surfaces of the shroud, the first and second volumetric portions communicating through openings formed between said lower edge portions of the leg portions and the lower floor portions of the chamber, the fuel inlet means directing liquid fuel onto upper and outer portions of the shroud to facilitate vaporization thereof, the vaporized fuel mixing with air present in the first volumetric portion of the chamber and moving downwardly within the chamber and through the openings and into the second volumetric portion, the fuel being vaporized by mixing with gaseous oxidizer delivered into the chamber through the air feed means.

13. The apparatus of claim 8 and further comprising means operably connected to the fuel inlet means for varying the flow of fuel into the mixing chamber.

14. The apparatus of claim 8 and further comprising means disposed within the interior of the chamber for providing evaporation surfaces which facilitate evaporation of the fuel.

15. The apparatus of claim 8 wherein the ducting means comprise a fuel return conduit extending from the housing to a fuel tank having an inlet port fitted with a removable cap, the distal end of the conduit extending through an aperture formed in the cap, and means carried by the cap for securing the distal end of the conduit thereto and allowing rotation of the cap relative to the body of the conduit.

16. Apparatus for mixing a vaporizable fuel and a gaseous oxidizer, comprising:

a housing defining a mixing chamber;

a shroud mounted within the mixing chamber, the shroud comprising an inverted, U-shaped structural element having opposed leg portions and an arcuate bight portion connecting upper edge portions of the leg portions, lower edge portions of the leg portions extending downwardly into spaced relation with lower floor portions of the chamber, the shroud extending throughout the chamber to separate the chamber into a first volumetric portion lying above and along outer surfaces of the shroud and a second volumetric portion lying within the confines of the shroud and bounded by inner surfaces of the shroud, the first and second volumetric portions communicating through openings formed between said lower edge portions of the leg portion and the lower floor portions of the chamber;

fuel inlet means formed in the housing for feeding fuel into the chamber directly over surfaces of the shroud to form a thin layer of fuel over the surfaces of said shroud to facilitate vaporization of the fuel, the fuel inlet means directing liquid fuel onto upper and outer portions of the shroud, the thin layer of fuel moving downwardly over outer surfaces of said shroud and vaporizing on such movement, the vaporized fuel mixing with air present in the first volumetric portion of the chamber and moving downwardly within a chamber through the openings and into the second volumetric portion;

air feed means carried by the housing for feeding gaseous oxidizer into the chamber and into mixing relation with the fuel vaporizing within the chamber, the fuel being vaporized by a mixing with the gaseous oxidizer delivered into the chamber through the air feed means; and, means communicating with the interior of the chamber and carried by the housing for ducting mixed fuel vapors and gaseous oxidizer from the chamber.

17. The apparatus of claim 16 and further comprising sump means carried by the housing for pooling unvaporized fuel and for returning the unvaporized fuel to a source of supply.

* * * * *